United States Patent [19]

Miebeler

[11] Patent Number: 4,934,118

[45] Date of Patent: Jun. 19, 1990

[54] STRESSING ELEMENT OF FIBER COMPOSITES AS WELL AS PROCESS AND DEVICE FOR THE STRESSING AND ANCHORAGE OF SUCH A STRESSING ELEMENT

[75] Inventor: Hans-Joachim Miebeler, Cologne, Fed. Rep. of Germany

[73] Assignee: Strabag Bau-AG, Cologne-Deutz, Fed. Rep. of Germany

[21] Appl. No.: 261,509

[22] Filed: Oct. 24, 1988

[30] Foreign Application Priority Data

Nov. 4, 1987 [DE] Fed. Rep. of Germany ..... 3737393

[51] Int. Cl.[5] ..... E04C 5/12

[52] U.S. Cl. ..... 52/223 L; 52/230

[58] Field of Search ..... 52/223 R, 223 L, 230, 52/231

[56] References Cited

U.S. PATENT DOCUMENTS

| | | | |
|---|---|---|---|
| 2,677,957 | 5/1954 | Upson | 52/230 |
| 3,212,222 | 10/1968 | Wittfoht | 52/230 |
| 3,956,797 | 5/1976 | Brandestini et al. | 52/230 |
| 4,069,677 | 1/1978 | Yamada et al. | 52/230 |
| 4,348,844 | 9/1982 | Schupack et al. | 52/230 |

FOREIGN PATENT DOCUMENTS

| | | | |
|---|---|---|---|
| 201840 | 1/1959 | Austria | 52/230 |
| 0025856 | 7/1984 | European Pat. Off. . | |
| 1097114 | 10/1957 | Fed. Rep. of Germany | 52/223 L |
| 1071931 | 12/1959 | Fed. Rep. of Germany | 52/223 L |
| 1130988 | 6/1962 | Fed. Rep. of Germany | 52/230 |
| 1278718 | 9/1968 | Fed. Rep. of Germany | 52/223 L |

*Primary Examiner*—Carl D. Friedman
*Assistant Examiner*—Caroline D. Dennison
*Attorney, Agent, or Firm*—Body, Vickers & Daniels

[57] ABSTRACT

A stressing element of fiber composites is disclosed as well as a process and device for the stressing and anchorage of such a stressing element, in which the stressing element ends are embedded in synthetic resin mortar in a transversely-corrugated anchoring or stressing sleeve, which deforms during stressing and allows cracks caused by stretching of the stressing bars inside the sleeve, which cracks divide up the anchorage body over a part of its length into slices and thereby allow a movement of the stressing bars under a vibrational loading effect. After stressing, the stressing bars of the stressing elements can be anchored by anchorage mortar introduced directly into encasing tube widenings.

5 Claims, 3 Drawing Sheets

STRESSING ELEMENT OF FIBER COMPOSITES AS WELL AS PROCESS AND DEVICE FOR THE STRESSING AND ANCHORAGE OF SUCH A STRESSING ELEMENT

BACKGROUND OF THE INVENTION

1. Field of the Invention

The invention relates to a stressing element of fiber composites for prestressed concrete compound units, ground anchors, rock anchors or the like, which has at least one end a stressing or anchoring sleeve which surrounds at a distance at least one stressing bar or a cluster of stressing wires of fiber composites and is filled with a synthetic resin mortar affinitive to the fiber composites, in which mortar the stressing bars or wires are embedded and which mortar establishes the adhesion-shear bond between the latter and the sleeve. The invention also relates to a process and a device for the stressing and anchorage of such a stressing element.

2. Description of the Prior Art

For the prestressing of prestressed concrete compound units, stressing elements with stressing bars or wires of fiber composites have been used recently, which have the advantage over stressing elements with high-strength steel bars or steel wires that they are corrosion-resistant and can also be used in compound units which are exposed to corrosive liquids or gases. Thus, for example, it is expedient to reinforce concrete tanks for liquid chemicals with stressing elements of fiber composites or to use stressing elements of fiber composites for rock or ground anchors which are exposed to ground water. In the case of stressing elements of fiber composites, however, their end anchorage in the concrete of the compound unit presents difficulties, since the stressing bars or clusters of stressing wires of organic or inorganic fibrous materials embedded in a synthetic resin matrix are sensitive to transverse pressure and cannot readily be clamped at the ends and tensioned in the way known with steel bars and also steel wires. In addition, the modulus of elasticity of fiber composites is considerably less than the modulus of elasticity of high-strength steels, so that the stressing elements of fiber composites have to be subjected to a great longitudinal stretching to achieve a sufficiently high prestressing.

An end anchorage for stressing elements of fiber composites is known (European Patent Specification No. 0,025,856), in which the stressing wires of fiber compositions are held between clamping plates, to which a transverse pressure, dependent on the stressing tensile force, is exerted and in which at the same time means are provided such that the clamping pressure does not rise too high, in order to keep the transverse pressure exerted on the stressing wires within allowable limits.

In order to grip stressing bars or stressing wires of fiber composites at their ends without damaging them and to apply a stressing force, it is also already known to house the ends of the stressing bars in sturdy cylindrical stressing or anchoring sleeves, where they are embedded in a synthetic resin mortar, which establishes an adhesion-shear bond between the stressing bars and the stressing or anchoring sleeve. In order to transfer the stressing forces introduced into the stressing sleeve by the stressing press onto the stressing bars or stressing wires of fiber composites embedded in the stressing sleeve, a large anchorage length is required, meaning that the rigid stressing or anchoring sleeves have a large length. This in turn hampers the winding-up of the stressing elements prefabricated at the works onto the stressing element drums, which are used for the transportation of the stressing elements to the construction site.

Above all, however, both known types of anchorage have the disadvantage that the fatigue strength of the stressing elements is inadequate at the points where the stressing bars or stressing elements of fiber composites enter between the clamping plates or into the stressing sleeve of the anchorage.

SUMMARY OF THE INVENTION

The object of the invention is to avoid these disadvantages of the known end anchorage and to design a stressing element of fiber composites in such a way that it can be stressed and securely anchored by simple means and have the necessary fatigue strength, particularly at the anchorage points, and can be easily connected to devices for functional monitoring.

This object is achieved according to the invention in that the stressing or anchoring sleeve consists of a corrugated walled tube which can be gripped by a stressing device, at least over a length adequate in relation to the load to be carried, and can be grouted-in the anchorage region of the respective compound unit.

This configuration has the advantage that the stressing or anchoring sleeve can stretch during application of the tensile stress by the stressing device and can thereby follow the stretchings which the stressing bars or wires undergo during application of the tensile stress. The synthetic resin mortar adhering to the stressing bars can therefore tear, at certain longitudinal intervals, transversely to the direction of tension, without the cohesion being lost, as the synthetic resin slices produced inside adhere to the stressing elements and are held at their outer edge by the corrugated tube which surrounds the synthetic resin mortar filling. The mortar slices thus produced allow a mutual displacement in the direction of force, so that the fatigue strength of the anchorage is improved. In addition, the adhesion-shear bond on the inside and outside of the corrugated tube with the surrounding mortar is considerably higher than in the case of a cylindrical stressing sleeve, and a thin-walled corrugated tube is considerably less expensive than a thick-walled threaded stressing sleeve or clamping anchorage devices. In addition, the corrugated tube can easily be gripped and stressed by a correspondingly adapted stressing device. The stressing or anchoring sleeve may be wound from thin-walled sheet metal strips which interlock at their edges with lock seams. During stressing, the windings of the anchoring sleeve can then yield in the lock seams.

The stressing or anchoring sleeves may consist of sheet steel or sheet aluminum and preferably having a sinusoidal corrugation. In this case, the crowns and valleys of the corrugations run in a circumferential direction, preferably along a spiral line. The stressing sleeve may then be screwed in a simple way into a correspondingly shaped coupling element of a device for the stressing and temporary anchorage of the stressing element against an abutting part.

The device necessary for the stressing and temporary anchorage of a stressing element against an abutting part has a supporting nut and a stressing device, the supporting nut and the threaded collar of the stressing device each having corrugated-tube threaded collar pieces forming their inner surfaces, by which they can screwthreadedly engage the screw-threaded corrugated tube of the stressing sleeve of the stressing element.

Such a device can be easily produced by fastening the corrugated-tube threaded collar pieces inside the threaded opening of the supporting nut and the threaded collar of the stressing device, using a synthetic resin adhesive or mortar. Such corrugated-tube threaded collar pieces which can be screwed onto spirally-shaped corrugated tubes are commercially available and can be easily obtained and worked.

For the end anchorage of a stressing element according to the invention which is laid at least temporarily longitudinally displaceably in an encasing tube having widenings at its ends for receiving the stressing or anchoring sleeves, an anchorage mortar is arranged in the widenings of the encasing tube, in which mortar the stressing or anchoring sleeves and/or the stressing bars or cluster of stressing wires led out therefrom and into the encasing tubes are embedded and which mortar establishes the adhesion-shear bond between the latter and the encasing tube widenings. The end of the stressing element already firmly anchored in the concrete of the compound unit before application of the prestress and provided with an anchoring sleeve is embedded in the concrete of the compound unit in such a way that the length of the anchoring sleeve necessary for transferring the use load from the stressing element onto the compound unit is secured in the concrete. The remaining part of the anchoring sleeve protrudes into the widening of the encasing tube and can, as described further above, follow the stretchings of the stressing bars which the latter undergo during stressing of the stressing element, so that in this region the synthetic resin mortar inside the anchoring sleeve tears apart in slices and the desired flexibility under fatigue loading of the compound unit is ensured.

Alternatively, it is also possible to grout-in the anchoring sleeve completely at the fixed anchoring end of the stressing element to such an extent that the stressing bars or wires are exposed in the region of the encasing tube widening, where they are embedded in the anchorage mortar only after stressing. The anchorage mortar is injected after stressing at least into the encasing tube widenings at the ends of the stressing element in order to establish the adhesion-shear bond between the stressing elements ends and the structure or the encasing tube widening embedded in the structure.

As the stressing bars are only embedded in the anchorage mortar after stressing to use load and up until then no relative movement has taken place between the stressing bars and the anchorage mortar surrounding them, at the beginning of the anchoring zone the bond is loaded only by the differential stresses which result from a fatigue loading and the stresses from the use load. Thus an adequate fatigue strength is achieved in this embodiment as well. In addition, the anchoring sleeve which is firmly grouted-in the concrete and is required for the fastening of the stressing bars during prestressing to use load can be kept much shorter, which facilitates the winding-up of the stressing elements, prefabricated in the manufacturing works, onto transport drums.

A similar procedure can also be adopted in anchoring of the initially longitudinally moveable stressing element end, on which the stressing press acts to stress the stressing element. Here it is possible to stretch the stressing element during stressing to the use load to such an extent that the stressing sleeve, with the stressing element end fastened to it, completely leaves the encasing tube widening surrounding it, it of course being necessary for it still to be gripped by the supporting nut in order to place the stressing element end on the abutting part for as long as it takes for the final bond between this stressing element end and the structural part to be established. After embedding in anchorage mortar the stressing bar ends which extend through the encasing tube widening, and after hardening of the mortar, the stressing bars or stressing wires can be cut off between the rear end of the stressing sleeve and the end face of the compound unit. The stressing force is then transferred directly from the stressing bars or wires through the anchorage mortar onto the structural part to be prestressed or the encasing tube widening which is embedded in this compound unit.

In addition, after cutting-off of the stressing sleeve, the stressing bar ends protruding from the prestressed pound unit are exposed, which allows the sensors of a monitoring device for monitoring the effectiveness of the stressing elements in the state of use, to be immediately fastended thereto.

In order also to increase the adhesion-shear bond between the anchorage mortar and the encasing tube widening, this encasing tube widening can, like the anchoring or stressing sleeves, consist of a steel or aluminium corrugated tube.

In order to facilitate the transportation of the stressing elements to the construction site, the stressing elements can also be cut to suitable lengths on the construction site itself, provided at their ends with the anchoring or stressing sleeves and bonded to the latter by synthetic resin mortar, which is then set in situ by heating of the anchoring or stressing sleeves with infrared radiators, microwave appliances or the like.

The anchorage described above may be used in cases of prestressing with bonding, in which the stressing element in its encasing tube is injected with a cement mortar or synthetic mortar over its entire length after prestressing. The anchorage may, however, also be used in the case of prestressing without bonding, such as in the case of rock anchors or ground anchors. In all cases, it is necessary that the injection mortar or the anchorage mortar which comes directly into contact with the stressing bars or stressing elements of fiber composite has a high affinity to the latter in order to transfer the forces through a good adhesion-shear bond from the stressing bars or wires to the anchorage parts surrounding them. Of course, the individual stressing bars or wires of each stressing element must also be sufficiently spaced from one another to be completely encased by the mortar.

BRIEF DESCRIPTION OF THE DRAWINGS

Preferred embodiments of the invention are described below by the way of non-limitative example with reference to the accompanying drawings, in which.

Figure 1:
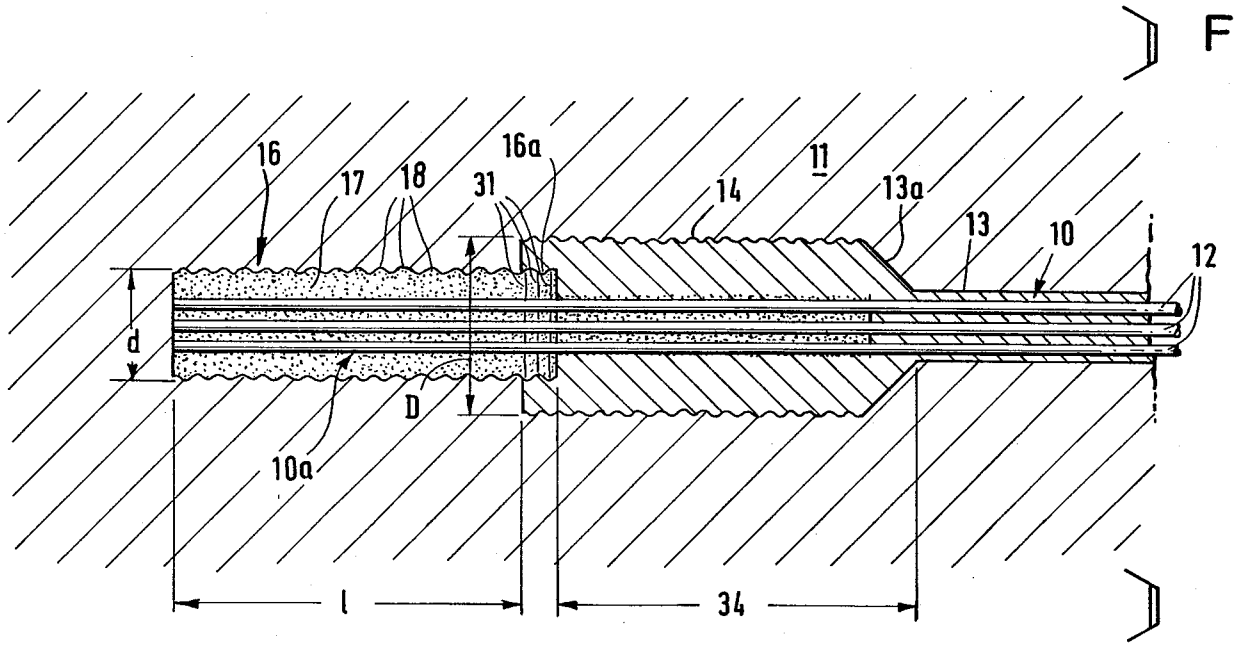
FIG. 1 shows a firm end anchorage for a stressing element of fiber composites in a concrete compound unit after injection of the anchoring zone, in longitudinal section.
Figure 2:
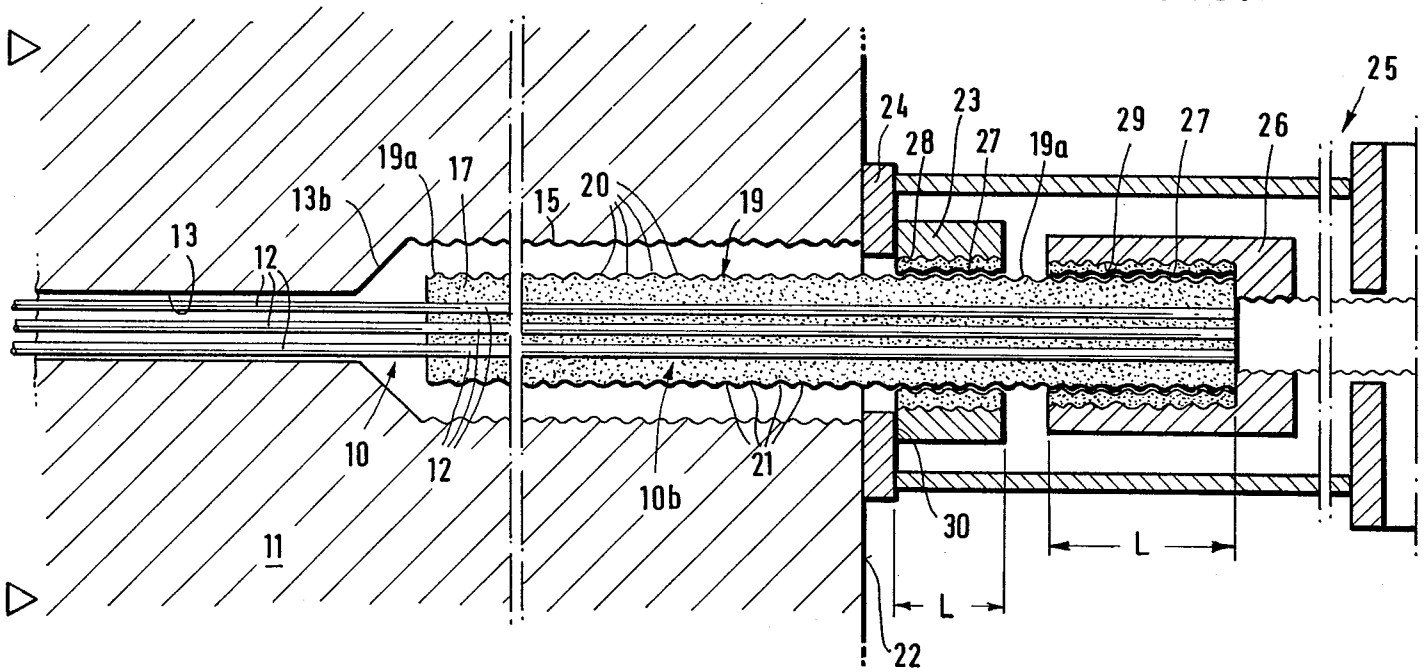
FIG. 2 shows the movable end, to be stressed, of a stressing element, with a stressing device attached to the structural part, before the beginning of stressing, in a partial longitudinal section.

In the drawings, 10 denotes a stressing element which is intended for the prestressing of a concrete compound unit 11 and consists of a plurality of stressing bars 12, which are disposed substantially parallel to one another. The stressing element 10 is laid in an encasing tube 13, which has at its rear end 13*a* and at its front end 13*b* in each case a widening 14 and 15 respectively. The encasing tube 13 may consist of plastic or sheet steel, the encasing tube widenings 14 and 15 are, however, preferably pieces of steel or aluminum corrugated tubes.

The stressing bars 12 are housed at the rear end 10*a* of the stressing element 10 in an anchoring sleeve 16, which surrounds the bars 12 at a distance and is bonded to the latter by a synthetic resin mortar 17, which has a high affinity to the fiber composite of the stressing bars 12. In the case of the exemplary embodiment represented here, the anchoring sleeve 16 consists of a longtitudinally-welded corrugated tube of sheet steel having a sinusoidal corrugation 18, the external diameter d of the anchoring sleeve 16 being somewhat smaller than the internal diameter D of the encasing tube widening 14.

It can be seen in FIG. 1 that the anchoring sleeve 16 protrudes slightly into the inside of the encasing tube widening 14, but is otherwise firmly grouted in the concrete compound unit 11. As long as the stressing element is not stressed, the encasing tube 13 and the encasing tube widening 14 are empty, i.e. they form a free space in which the stressing bars 12 of the stressing element 10 can stretch unhindered. The rear end 10*a* of the stressing element 10, which is firmly bonded to the anchoring sleeve 16 by the mortar 17, is, on the other hand, firmly held in the concrete of the compound unit 11.

The front end 10*b* of the stressing element 10 is, similarly to the rear end, arranged in a stressing sleeve 19, in which the stressing bars 12 are embedded with a synthetic resin mortar 17. The stressing sleeve 19 likewise consists of a corrugated tube having sinusoidal corrugation, the crowns 20 and valleys 21 of which run along a spiral line. The stressing sleeve may, like the anchoring sleeve 16, consist of a longitudinally-welded steel corrugated tube. In the present case, the corrugated tube is, however, wound from thin-walled sheet metal strips which interlock at their edges with lock seams.

The stressing sleeve 19 is surrounded at a distance by the encasing tube widening 15 and protrudes forwards slightly beyond the front end face 22 of the concrete compound unit 11. Screwed onto this protruding front end 19*a* of the stressing sleeve 19 is a supporting nut 23, which bears against an annular anchor plate, serving as abutting part 24. Also placed against this anchor plate is a stressing device, generally denoted by 25, which grips the stressing sleeve 19 and thereby the stressing element 10. The device 25 may draw out the stressing element 10 from the encasing tube 13 and thereby prestress it.

For the purpose of gripping the stressing sleeve 19 the stressing device is provided with a threaded collar 26, which is screwed onto the front end 19*a* of the sleeve 19. As supporting nuts and threaded collars which have a thread matching the corrugated tube threading of the stressing sleeve 19 are not readily available, the supporting nut 23 and the threaded collar 26 are produced by corrugated-tube threaded collar pieces 27 being cemented into the threaded opening 28 of a commercially available nut and into the threaded opening 29 of a commercially available threaded collar with a synthetic resin adhesive or mortar. The supporting nut 23 and the threaded collar 26 can then be screwed readily onto the free front end 19*a* of the stressing sleeve 19, the length L of which can be gripped by the threaded collar 26 and the supporting nut 23 being just as large as the anchorage region l of the anchoring sleeve 16, which corresponds to the use load to be carried.

Figure 3:
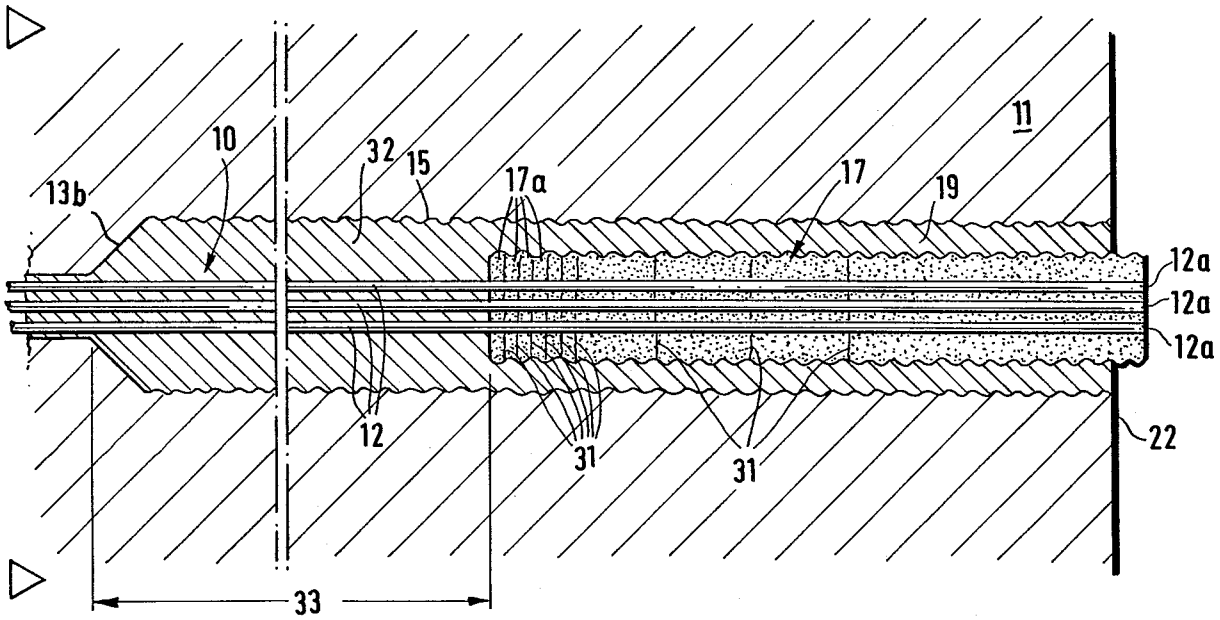
FIG. 3 shows the end anchorage of the movable stressing element end after stressing and injection of the anchorage region, in longitudinal section.

To stress the stressing element 10, the stressing sleeve 16, with the stressing bar ends fastened to it, is drawn bit by bit out of the encasing tube widening 15. In this operation, the stressing sleeve 19 is from time to time supported by readjustment of the supporting nut 23 by means of an interposed sliding layer 30, as is known per se in the prestressing of stressing elements. This causes the stressing bars 12 to be stretched, this stretching continuing into the inner end 16*a* of the anchoring sleeve and into the inner end 19*a* of the stressing sleeve 19. Since the synthetic resin mortar 17 firmly adheres to the stressing bars 12, but cannot completely follow the stretching of the stressing bars 12, cracks 31 occur in the synthetic resin mortar, which run transversely to the longitudinal direction of the stressing element and break up the mortar plug at the inner end in each case into generally thin slices 17*a*, which are held together however around their outer periphery by the anchoring sleeve 16 or the stressing sleeve 19 (FIGS. 1 and 3). This breaking up of the synthetic resin mortar plug 17 into thin slices provides the stressing bars 12 with a certain mobility inside the stressing sleeve 17 and the anchoring sleeve 16, which enables them flexibly to absorb vibrations of the concrete compound unit.

After the stressing of the stressing element 10, the hollow spaces enclosed by the encasing tube widenings 14 and 15 are filled with an anchorage mortar 32, which can also be injected into the encasing tube 13 if a solid bond between stressing element and concrete compound unit is to be established. In this case, the anchorage mortar 32 indirectly produces over virtually the full length of the rear encasing tube widening 14 and in the rear region 33 of the front encasing tube widening 14 an adhesion-shear bond to the corrugated tube of the encasing tube widenings 14 and 15. In this anchorage region, which is also referred to as "pre-length" and is indicated in FIG. 3 by 33 and in FIG. 1 by 34, the stressing bars 12 are not embedded in the anchorage mortar until they are already in the prestressed state. Any dynamic loading which may occur is therefore only small in this region.

It will be appreciated that an end anchorage of the front, initially movable end 10*b* of the stressing element 10 is also possible if the stressing sleeve 19 is drawn completely out of the compound unit 11 until the use load is reached and then the stressing bars 12, which alone remain in the encasing tube widening 15, are embedded in the anchorage mortar 32. When this anchorage mortar 32 has completely hardened, the stressing bars 12 can be cut through between the drawn-out stressing sleeve 19 and the front end face 22 of the abutting part. They then individually protrude slightly beyond the front end face 22 of the concrete compound unit 11 and can be connected directly to the sensors of a monitoring unit, not shown in any more detail here. Such a sensor connection is, of course, also possible at the ends 12*a* of the stressing bars 12 if the latter are embedded in the stressing sleeve 19.

The invention is not restricted to the exemplary embodiments described and shown, instead a number of modifications and additions are possible without departing from the scope of the invention. For example, the anchoring sleeve 16 may also be long enough at the rear end 10*a* of the stressing element 10 (the end to be firmly concreted-in) that it virtually completely fills the encasing tube widening 14. Cracks 31 then occur in the synthetic resin mortar 17 in that region of the anchoring sleeve which is inside the encasing tube widening 14.

I claim:

1. A stressing element for use in a prestressing structure which comprises:

at least one fiber composite elongate stressing member having first and second end regions;

at least one stressing sleeve surrounding one of said end regions, comprising a corrugated-walled tube for gripping by the a stressing device over a length adequate in relation to the load to be carried, and adapted for grouting-in an anchorage region of said structure, and, a body of synthetic resin mortar adhesively binding said fiber composite elongate stressing member disposed within said tube said body of synthetic resin mortar preventing axial movement of said stressing member and said tube preventing axial movement of said mortar body.

2. The stressing element as claimed in claim 1, wherein said tube is wound from thin-walled sheet metal strips which interlock at their edges with lock seams.

3. The stressing element as claimed in claim 1 wherein said tube consists of sheet steel, sheet aluminum or plastic.

4. The stressing element as claimed in claim 1 wherein said tube has a sinusoidal corrugation.

5. The stressing element as claimed in claim 1 wherein said corrugated walled tube was crowns and valleys and said crowns and valleys of the corrugation run circumferentially around said tube along a spiral line.

* * * * *

UNITED STATES PATENT AND TRADEMARK OFFICE

CERTIFICATE OF CORRECTION

PATENT NO. : 4,934,118

DATED : June 19, 1990

INVENTOR(S) : Hans-Joachim Miesseler

It is certified that error appears in the above-identified patent and that said Letters Patent is hereby corrected as shown below:

Title Page, Item [19], "Miebeler" should read --- Miesseler ---; Title Page, Item [75] Inventor, line 1, "Miebeler" should read --- Miesseler ---.

Signed and Sealed this

Twelfth Day of March, 1991

*Attest:*

HARRY F. MANBECK, JR.

*Attesting Officer*

*Commissioner of Patents and Trademarks*